United States Patent [19]

Pugh

[11] 3,946,895

[45] Mar. 30, 1976

[54] CONTAINER LID WITH TEAR-OUT CLOSURE AND STRAW

[76] Inventor: William A. Pugh, 5200 S. Harper Ave., Chicago, Ill. 60615

[22] Filed: May 30, 1974

[21] Appl. No.: 474,862

[52] U.S. Cl. ..... 220/269; 229/7 S

[51] Int. Cl.[2] ..... B65D 41/32

[58] Field of Search ..... 220/212, 270, 90.2, 269; 229/7 S

[56] References Cited

UNITED STATES PATENTS

| | | | |
|---|---|---|---|
| 3,071,303 | 1/1963 | Pugh | 229/7 S |
| 3,215,329 | 11/1965 | Pugh | 229/7 S |
| 3,226,001 | 12/1965 | Sequeira | 229/7 S |
| 3,254,790 | 6/1966 | Dunn | 220/270 |
| 3,263,855 | 8/1966 | Pugh | 220/212 |
| 3,303,985 | 2/1967 | Prokes | 229/7 S |
| 3,425,591 | 2/1969 | Pugh | 220/270 |
| 3,451,523 | 6/1969 | Evans | 198/261 |
| 3,731,836 | 5/1973 | Silver | 220/269 |
| 3,796,344 | 3/1974 | DePhillips | 220/269 |

*Primary Examiner*—William Price
*Assistant Examiner*—Ro E. Hart
*Attorney, Agent, or Firm*—Clarence A. O'Brien; Harvey B. Jacobson

[57] ABSTRACT

A container lid with a tear-out strip forming a closure therefor in which the strip and its pull ring remains attached to the lid and container while enabling the contents to be removed by utilizing a straw disposed within the container which will pop up into position for use when the tear-out closure is elevated by using the pull ring. When an aluminum lid or non-ferrous lid is used, an insert of ferrous material is mounted in sealed relation on the container lid or on the container bottom in the event a two-piece can is used which enables pick-up and handling of discarded containers by using magnetic devices to facilitate recycling of the containers. The straw is supported by a plastic apron and the lid provided with an air channel to enable the apron to be positioned in a vertical position for receiving an end portion of the straw therethrough. The tear-out closure and pull ring are constructed so that the pull ring may initiate breakthrough of the tear-out closure with application of a relatively small force. The lid is also provided with means for enabling it to be oriented in a machine for assembling the straw and lid for association with the container.

12 Claims, 7 Drawing Figures

Fig. 2

CONTAINER LID WITH TEAR-OUT CLOSURE AND STRAW

BACKGROUND OF THE INVENTION

1. Field of the Invention

The present invention generally relates to containers of the type having a lid with a tear-out closure and a pull ring connected thereto by which the tear-out closure may be moved to a position for providing access to the contents of the container with the tear-out closure being connected to the lid, thus eliminating the provision of a separate tear-out closure which are usually discarded thus causing objections to the use of presently available tear-out closures which are separable from the container lid. The present lid also includes a straw attached to the tear-out closure, ferrous means to enable magnetic pick-up devices to be used and means for locating the lid in proper orientation in relation to straw assembling machinery for assembling the straw and lid.

2. Description of the Prior Art

Many patents have been granted on container lids having tear-out closures including applicant's prior Pat. Nos. 3,263,855, 3,295,715 and 3,425,591 and many efforts have been made to provide improvements in these structures. With the advent of aluminum cans, conventionally employed magnetic pick-up devices would no longer pick up discarded cans and the tear-out strips and pull rings which become separated from the cans form a source of litter themselves. Discarded cans and their unsightliness have prompted some ordinances and regulations to be enacted regarding distribution of non-returnable containers for beverages and the like.

SUMMARY OF THE INVENTION

An object of the present invention is to provide a container lid having a tear-out closure that remains with the lid and a straw attached to the tear-out closure for movement to an accessible position when the tear-out closure is moved to open the container by applying appropriate pulling force to a pull ring in which the tear-out closure and pull ring cooperate with score lines oriented between beads formed in the lid.

Another object of the invention is to provide a lid in accordance with the preceding object in which the pull ring is provided with a rounded and downwardly extending nose portion which is engaged with a cut score and die score in the lid in opposed relation to each other between rigidifying beads thereby facilitating breakthrough of the tear-out closure.

A further object of the invention is to provide a lid in accordance with the preceding objects in which the straw is connected to the tear-out closure by a depending plastic apron that normally lies alongside the under surface of the lid when the lids are nested or stacked prior to assembly with a container with the lid having an air channel formed therein to enable a stream of air to be directed toward the air channels for moving the plastic apron to a vertical position for receiving the end portion of the straw.

Still another important object of the invention is to provide a lid in accordance with the preceding objects in which the plastic apron is provided with radial lines of severance and a circular central opening to enable a straw to be pushed therethrough with the free arcuate ends of the triangular sections formed by the radial lines of severance serving to grip and retain the straw in position therein.

A still further object of the invention is to provide a lid which, if constructed of non-ferrous material, such as aluminum, is provided with a ferrous insert or washer exposed to the exterior thereof and provided with a sealing material to prevent oxidation to enable the discarded containers to be picked up by magnetic devices and also enabling the lids to be handled by magnetic devices prior to assembly with the cans.

Yet another feature of the invention is to provide a lid having a paint dot incorporated thereon to facilitate location and orientation of the lids by the use of a photocell assembly sensitive to the paint dot to enable the lid and straw to be properly oriented in a machine for assembling the straw and lid.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
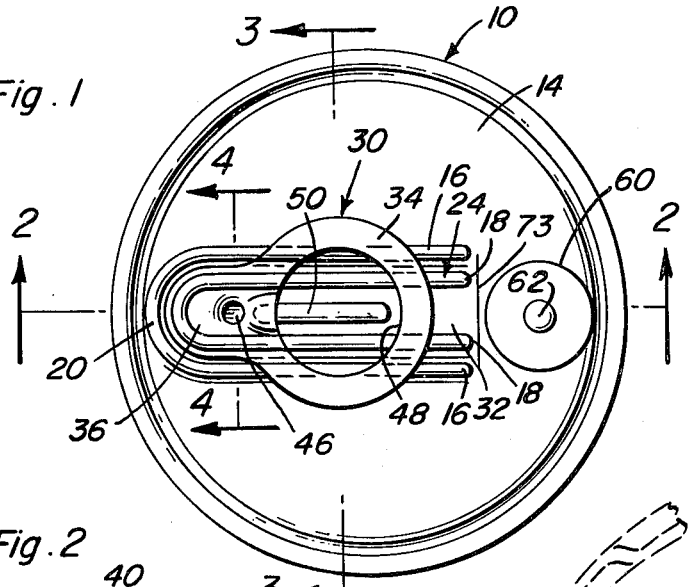
FIG. 1 is a top plan view of the container lid of the present invention.
Figure 2:
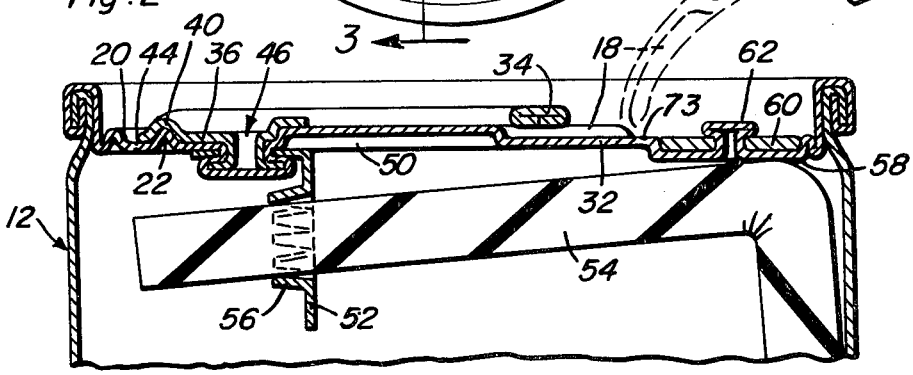
FIG. 2 is a sectional view taken substantially upon a plane passing along section line 2—2 of FIG. 1 illustrating the specific structural details of the lid, tear-out closure, straw and ferrous washer.

Referring now specifically to the drawings, the container lid incorporating the present invention therein is generally designated by the numeral 10 and is illustrated in association with a conventional container 12 with the periphery of the lid being secured to the can 12 in a conventional and well known manner. Formed in the lid, which in the case of FIGS. 1–5 includes a relatively thin lid member 14 of aluminum, is a pair of parallel outer beads 16 and a pair of parallel inner or medial beads 18 which have the ends thereof adjacent the periphery of the lid member 14 being interconnected by U-shaped or semi-circular portions 20 and 22, respectively, as illustrated in FIGS. 1 and 2. The other ends of the beads 16 and 18 terminate in spaced relation to the periphery of the lid member 14 as illustrated in FIGS. 1 and 2.

Figure 5:
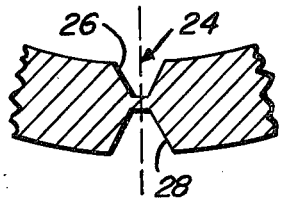
FIG. 5 is a sectional view, on an enlarged scale, illustrating the score lines between the outer and medial beads.

Interposed in the space between the beads 16 and 18 is a score line 24 which is continuous and as illustrated in FIG. 5 includes a generally V-shaped cut score 26 on the top surface of the lid member and a die score 28 in opposed relation to the cut score 26 on the under surface of the lid member 14 with the die score being generally triangular or other suitable configuration so that the score line 24 is disposed between the beads 16 and 18 and between the connected bead portions 20 and 22 with the score line 24 extending throughout the length of the beads.

A pull ring assembly generally designated by the numeral 30 is connected to the lid member inwardly of the medial bead 18 which area defines a tear strip 32 along with the medial bead 18 and the connecting bead 22. The pull ring assembly 30 includes a pull ring 34 provided with a projecting nose portion 36 at one edge thereof which overlies a portion of the strip 32 and a portion of the medial bead 18 and terminates in a peripheral edge in alignment with the score line 24 as illustrated in FIGS. 1–4.

As illustrated, the pull ring 34 overlies and engages the top surfaces of the beads 16 and 18 and includes in the portion 36 thereof a bead portion 38 which conforms with the medial bead 18 and a connecting bead portion 40 which overlies and conforms with the connecting bead 22 as illustrated in FIG. 2 so that the downturned edge 44 of the nose portion 36 of the pull ring 34 is disposed in exact alignment with the score line 24 to provide a breakthrough point for the score line when opening the container.

The pull ring assembly is secured to the strip 32 by a drawdown rivet assembly generally designated by numeral 46 which is similar to the drawdown rivet structure disclosed in my prior patents mentioned previously in which the continuity of the lid is not broken and the pull ring assembly is fixedly secured to the strip 32 so that as the pull ring 34 is elevated by inserting a finger through the opening 48 therein and lifting, the pull ring assembly 30 will fulcrum about the drawdown rivet causing the downturned end 44 to move downwardly and breakthrough the score line 24 so that the strip 32 and medial bead 18 may be pulled upwardly by tearing along the score lines 24 which terminate adjacent to a transverse indented score line 73 which serves as a stop for the tear out strip 32 and will act as a hinge for the strip so that it will not flip back and hit the user in the face. The strip 32 is continuous with the lid and thus securely retains the tear-out portion of the lid in attached condition to the lid so that the pull ring assembly will not be separated from the container.

The central portion of the strip 32 is provided with an air channel 50 therein which parallels the beads 16 and 18 and is located centrally between the medial beads 18 with the air channel extending from a position adjacent the drawdown rivet to a position generally aligned with the remote portion of the pull ring 34 as illustrated in FIGS. 1 and 2. The air channel 50 together with the beads 18 and 16 fortify or reinforce the tear out strip and the score lines 24 to assure proper breakthrough and separation along the score lines. Also, the air channel 50 is to facilitate movement of a plastic apron 52 from a horizontal position underlying the lid to a vertical position for receiving one end of a plastic straw 54.

Figure 3:
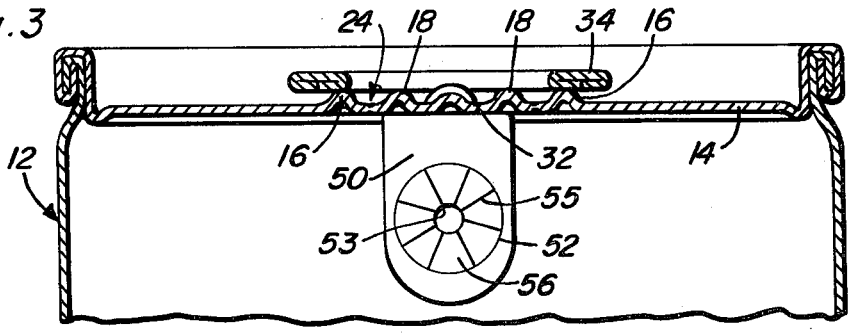
FIG. 3 is a transverse, sectional view taken substantially upon a plane passing along section line 3—3 of FIG. 1 illustrating the relationship of the outer beads, medial beads and air channel formed in the lid and the associated pull ring oriented in overlying relation thereto, with the straw omitted.
Figure 4:
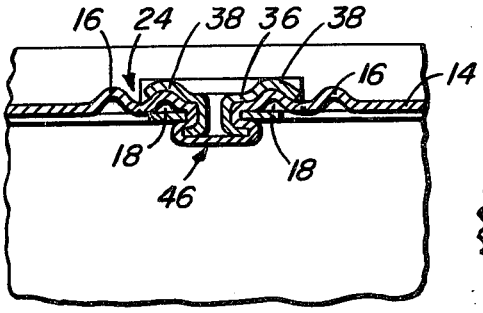
FIG. 4 is a detailed sectional view taken substantially upon a plane passing along section line 4—4 of FIG. 1 illustrating the drawdown rivet connection between the pull ring and tear-out closure illustrating the association of the pull ring with the score lines in the closure member.

The plastic apron 52 is assembled with the drawdown rivet 46 as illustrated in FIG. 2 thus forming a permanent assembly therewith with the plastic apron underlying and engaging the bottom surface of the lid so that the lid may be nested or stacked with similar lids prior to assembly with the straw and can. In the machinery for assembly of the straw 54 and the lid 10, an air stream will be directed toward the air channel 50 in an inclined manner so that air engaging the channel 50 will pass between the channel 50 and the upper surface of the apron 52 and cause the apron 52 to move downwardly or flex downwardly into a vertical position so that the end of the straw 54 may then be inserted through the opening formed in the apron 52. The opening in the apron 52 is defined by providing a central small opening 53 and a plurality of radial lines of severance or cut lines 55 thus defining segments 56 in the shape of a slice of pie which frictionally engage the periphery of the straw with the apices of the segments 56 being concave in configuration as shown in FIG. 3 so that they will engage the periphery of the straw and securely bite into and lock the straw in place, to prevent spinning or rotation thereof. This retains the straw in position during assembly with the container but yet enables the straw to move upwardly through the opening defined in the container lid 10 when the closure assembly is opened.

When an aluminum lid is used, a recess or pocket 58 is formed therein for receiving a ferrous washer 60 therein which is secured in place by a drawdown type rivet 62 with the washer being alternatively secured by a hot melt plastic or other suitable material and sealed by a plastic overlay. The ferrous washer 60 is thus prevented from oxidation and provides means by which the container and container lids may be lifted, handled and collected by using a magnetic pick-up device. The washer is oriented between the ends of the beads 16 and 18 and between the end of the strip 32 and the periphery of the lid member 14. This ferrous washer 60 also enables the lid 10 to be oriented properly in relation to a machine for assembling the straw with the lid by directing air toward the air channel 50.

Figure 6:
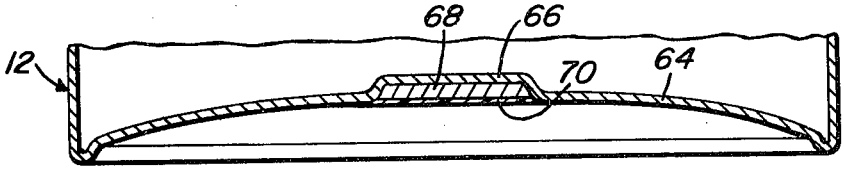
FIG. 6 is a detailed sectional view of a bottom portion of the container of the two-piece type in which the ferrous washer is incorporated into the bottom of the container.

FIG. 6 illustrates an alternative structure to facilitate handling or picking up of discarded containers in which the container bottom 64 is provided with a recess 66 which receives a ferrous slug 68 secured in place by any suitable means, such as by a hot melt sealant 70 or the like. This type of construction is especially useful in association with two-piece containers to enable the containers to be handled during filling and packaging by magnetically holding on high speed conveyors as well as facilitating their recovery by magnetic pickup when discarded and facilitating their handling during recycling.

Figure 7:
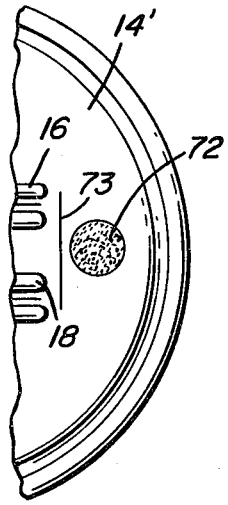
FIG. 7 is a fragmental plan view of another type of lid illustrating a paint dot utilized thereon rather than the ferrous washer to facilitate location of a steel lid in the machinery for assembling the straw and lid.

FIG. 7 illustrates a modified form of lid member 14′ in which a paint dot 72 is provided on the lid member 14′ in the same location as the ferrous washer 60 in the embodiment of the invention illustrated in FIGS. 1–4. The paint dot is placed in a circular depression on the top surface of the lid which is of ferrous construction. This prevents roll off and provides a round circular dot. The paint dot is dryed by ultra violet radiation which provides instant drying without the use of large cumbersome dryers and accompanying objectionable fumes. The paint dot is protected by a plastic overlay which prevents the paint from being scratched off or abraded during handling. The paint dot is used with the steel lid where the machinery for inserting the straw is provided with a photocell assembly which is sensitive to the paint dot so that when the lid is rotated and the paint dot becomes oriented in a particular position, the lid will be stopped so that the air stream will be directed into the air channel 50 and the plastic apron 52 moved to a vertical position and the straw 54 inserted therethrough.

Thus, there has been illustrated an aluminum lid and a steel lid, each of which includes the two outer beads and the two medial beads and the central air channel or bead therebetween with a score line between the outer and medial beads. The pull ring lies on top of the beads with space thereunder to enable the ring to be pulled upwardly from the lid. The drawdown rivet provides a large fulcrum area and holds the plastic straw retaining apron to the underside of the lid and the air channel enables air to blow down the apron to a vertical position to hold the straw in place in the can. The ferrous washer may be riveted to the top of the can surfaces or a round slug can be dropped into a circular indentation and held in place by hot melt with both types being covered by a plastic overlay which prevents oxidation. The steel lid has a painted dot to stop the lid in position to insert the straw through the apron in the apparatus for assembling the straw and lid with the cut lines in the apron serving to form an orifice in the skirt and the tabs or pie-cut-shaped members clinging to the outside diameter of the straaw and holding the same in parallel relation to the under surface of the lid. The lids of the present invention are nestable and stack easily with the apron lying over the air channel when stacked so that the apron will fall vertically when air traverses the air channel bead. The steel lid with the painted dot thereon which is aligned with the apron will align the straw with the apron by the use of a photocell alignment device which activates a brake on the fixture to align the straw with the apron. The ferrous washer on the aluminum lid will hold the lid in situ by use of a magnet to align the straw with the skirt or apron.

The outer beads and medial beads are parallel with the score 26 in between being coincident with an underside score 28 with the scores having sides at a 45° angle (approximately) with the sides being compacted by the mandrel with the compacted metal in the sides affording a sharper breakthrough without a serrated edge, hence a clean crystalline breakthrough. The pull ring and strip stays with the can so that when discarded cans are collected, the pull ring and closure will also be collected, thus providing ecological benefits. The pull ring is of one-piece construction and held tight to the lid by the tongues on the drawdown rivet assembly with the tongues acting as a pry or fulcrum so that when the ring is rocked forwardly, it will afford a breakthrough of the lid with the ring then being pulled up and back to skin back the tear-out strip which has the pull ring as an integral part and both the ring and tear-out strip remain attached to the lid, thus reducing litter from discarded tear-out strips and pull rings.

The lid, of course, may be used without the straw and apron when used with commodities in which a straw is not normally used. In this event, the air channel as well as the apron are eliminated and the tear strip, beads and score lines can be made shorter with the transverse score line nearer the center of the lid. The slug of ferrous material may be in the form of a solid slug as well as a washer shape to enable complete use of the ferrous surface when using a magnetic pickup.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A container closure comprising a lid forming the end of a container, a pair of closely spaced generally parallel and concentric beads formed in the lid and projecting upwardly from the upper surface thereof, the beads being interconnected by a pair of connecting bead portions thus forming generally U-shaped outer and inner beads, a score line between said beads to define a line of separation, said beads and score line having terminal ends spaced from an edge of the lid and defining a tear-out strip, a pull ring assembly attached to the lid and overlying the inner bead and the connecting bead portion thereof with the pull ring assembly including a nose portion conforming with the connecting portion of the inner bead and overlying and contacting the score line between the connecting bead portions to provide breakthrough between the beads for pulling the tear-out strip upwardly and leaving the end thereof remote from the connecting portions of the beads attached to the lid.

2. The structure as defined in claim 1 wherein said strip includes a straw connected to and extending along the under surface thereof, a flexible resilient apron mounted on the strip and receiving the straw and connecting the straw to the strip for movement of the straw with the strip when pulled upwardly to expose the straw for use in consuming the contents of the container, said strip having an air channel in the under surface thereof by which air blown into the channel will deflect the apron downwardly to a vertical position for receiving the straw therethrough.

3. The structure as defined in claim 2 wherein said lid includes a distinguishably colored dot thereon to enable the lid to be oriented by lid and straw assembly machinery having a photocell assembly sensitive to the colored dot.

4. The structure as defined in claim 2 wherein said apron includes a central opening and radial cut lines receiving and gripping a staw when inserted therethrough, a lid-mounted-ferrous member being aligned with the apron to facilitate positioning of the lid in alignment with an air discharge and the straw when assembling the lid and straw.

5. The structure as defined in claim 4 wherein said lid includes a transverse score line at the permanently attached end of the tear-out strip defining a hinge about which the tear-out strip swings thereby preventing the strip from swinging back into contact with the facial area of a person consuming the contents of the container.

6. The structure as defined in claim 2 wherein said flexible apron includes a central small opening and a plurality of radial cut lines extending therefrom to define a plurality of pie-slice-shaped segments which are deflected when a straw is forced through the apron and frictionally gripping the periphery of the straw.

7. The structure as defined in claim 6 together with a ferrous insert in said lid and being exposed to the exterior only to enable handling and pick up of a non-ferrous lid by magnetic handling and pick-up equipment, said lid including a pair of adjacent, concentric, raised beads thereon, a score line between said beads to define a line of separation, said beads and score line having connecting portions adjacent the peripheral edge of the lid and terminal ends spaced inwardly from an opposite edge portion of the lid thus defining a tear-out strip having one end permanently of unitary construction with the lid, and a pull ring assembly attached to said strip adjacent the connecting portions of the beads, said pull ring assembly including a nose portion conforming with the connecting portion of the inner concentric bead and terminating in a downturned edge in overlying engagement with the connecting portion of the score line to facilitate breakthrough of the score line when the pull ring is elevated, said ferrous member being disposed between the terminal ends of the beads and edge of the lid.

8. The structure as defined in claim 1 together with a ferrous insert in said lid and being exposed to the exterior only to enable handling and pick up of a non-ferrous lid by magnetic handling and pick-up equipment.

9. The structure as defined in claim 1 wherein said lid includes a transverse score line therein at the end of the strip remote from the nose portion of the pull ring assembly to form a hinge for upward swinging movement of the strip and pull ring assembly to retain the strip and pull ring assembly permanently connected to the lid in peeled back open position, said transverse score line forming a stop for the ends of the score line and prevent flip back movement of the strip and pull ring assembly.

10. The structure as defined in claim 1 wherein said score line is defined by aligned depressed grooves in the top and bottom surfaces of the lid, said depressed grooves being generally V-shaped and formed by compacting metal in the side walls thereof rather than removing material thereby facilitating breakthrough by providing a snap break rather than a lacerated tear.

11. The structure as defined in claim 1 wherein said pull ring assembly and strip include a drawdown connection having a hollow interior defining a rigid connection located adjacent the nose portion whereby the nose portion will fulcrum with the drawdown connection when the end of the pull ring assembly remote from the nose portion is pivoted upwardly, said hollow drawdown including a riveted area peripherally thereof defining an enlarged fulcrum area for the pull ring assembly.

12. The structure as defined in claim 1 wherein said lid includes means thereon to facilitate proper orientation of the lid, means on the container to facilitate magnetic pickup when a non-ferrous container is used, and depending means to grippingly support and retain a straw with the lid after products have been consumed thereby retaining all components of the lid and container assembled to facilitate disposal thereof for providing an ecology benefitting lid and container.

* * * * *